US012668350B1

(12) United States Patent
Frank

(10) Patent No.: US 12,668,350 B1
(45) Date of Patent: Jun. 30, 2026

(54) THERMAL ENERGY COMPENSATOR

(71) Applicant: The United States of America, as represented by the Secretary of the Navy, Arlington, VA (US)

(72) Inventor: Matthew V. Frank, Chadds Ford, PA (US)

(73) Assignee: The United States of America, as represented by the Secretary of the Navy, Arlington, VA (US)

( * ) Notice: Subject to any disclaimer, the term of this patent is extended or adjusted under 35 U.S.C. 154(b) by 153 days.

(21) Appl. No.: 18/821,804

(22) Filed: Aug. 30, 2024

Related U.S. Application Data

(60) Provisional application No. 63/579,595, filed on Aug. 30, 2023.

(51) Int. Cl.
*B63J 2/02* (2006.01)
*B63J 2/12* (2006.01)

(52) U.S. Cl.
CPC .. *B63J 2/02* (2013.01); *B63J 2/12* (2013.01)

(58) Field of Classification Search
CPC ..... B63J 2/02; B63J 2/12
See application file for complete search history.

(56) References Cited

FOREIGN PATENT DOCUMENTS

| | | | | | |
|---|---|---|---|---|---|
| CN | 105673210 | B | * | 7/2017 | ..... F02C 6/00 |
| CN | 107289670 | A | * | 10/2017 | ..... F22B 1/1807 |
| KR | 20100105931 | A | * | 10/2010 | ..... F24D 15/04 |
| KR | 101767556 | B1 | * | 8/2017 | ..... B63J 2/06 |
| KR | 102453315 | B1 | * | 10/2022 | ..... B63J 2/12 |
| KR | 20220164598 | A | * | 12/2022 | ..... H01S 3/04 |
| WO | WO-2023056400 | A1 | * | 4/2023 | ..... F28F 3/086 |

* cited by examiner

*Primary Examiner* — Kun Kai Ma
(74) *Attorney, Agent, or Firm* — Naval Surface Warfare Center, Philadelphia Division; Mark J. Rosen

(57) ABSTRACT

Provided is a thermal energy compensator providing relatively constant temperature water to a distributed cooling system.

5 Claims, 1 Drawing Sheet

THERMAL ENERGY COMPENSATOR

STATEMENT OF GOVERNMENT INTEREST

The invention described herein may be manufactured and used by or for the Government of the United States of America for governmental purposes without payment of any royalties thereon or therefor.

FIELD OF THE INVENTION

The invention is related to the field of temperature consistency in water distribution systems.

BACKGROUND OF THE INVENTION

Many absorption and adsorption cycles use water (R-718) as the working fluid refrigerant in a closed loop cycle. Manufacturers, mainly in Europe, are marketing closed-loop R-718 (water) chillers. Vacuum levels are being achieved. However, temperature varies in such systems in a less than optimal manner.

The art is in need of solutions enabling more consistent temperature in such systems.

SUMMARY OF THE INVENTION

The invention is directed to a thermal energy compensator which provides a relatively constant water distribution temperature aboard Navy ships. The invention is particularly useful in embodiments in which it is particularly important to address systems in which the cooling requirements are sporadic rather than continuous, such as with weapon systems (e.g., solid state laser, electro-magnetic rail gun, high-powered radar systems, etc.), or other systems in which demand varies widely over time.

In one aspect, the invention provides methods and devices for cooling systems with relatively constant water distribution temperature.

These and other aspects of the invention will be readily appreciated by those of skill in the art from the description of the invention herein.

DETAILED DESCRIPTION OF THE INVENTION

Figure 1:
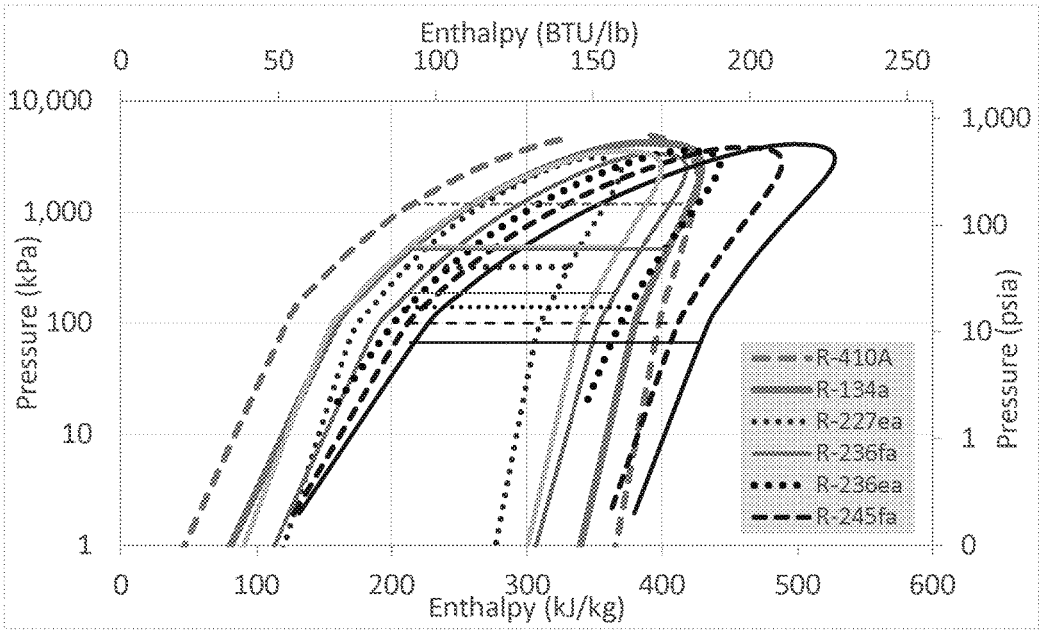
FIG. 1 provides pressure-enthalpy diagrams for a variety of refrigerants.

Current and future shipboard equipment can be divided into two types, continuous operations and sporadic operations. The electrical power demands and cooling requirements of continuous operating equipment must be supported on a full time basis and must be considered as an absolute minimum in appropriate sizing of electrical power and thermal systems designed to support such equipment. Sporadic equipment loads are of short duration but also must be supported by well-designed electrical and thermal energy storage systems.

For future equipment in particular, the approach in the art to meeting these requirements tends to be simplistic: installation of a large numbers of generators (such as gas turbine or diesel generators) and air conditioning plants such that their capacities match the calculated design loads. But as future equipment increases its demands on power and cooling, this increase has greater implications far beyond the obvious impact on ship system size, weight, and cost due to the significant quantity of additional necessary equipment. For example, the increase in generators and air conditioning plants necessitates additional supporting ship system pumping, distribution piping, associated maintenance and operator efforts, much of which will be even more onerous. While designing larger capacity plants may mitigate some of the increase, larger plants also introduce new difficulties in terms of starting the plants, maintenance and repair of larger machinery, poor performance at part-loads (typical operating conditions), etc. In shipboard systems, physically larger ships will be required to accommodate these systems, which will impact operating speeds and costs.

Shifting the design paradigms and considering new methodologies for thermal energy storage is needed, especially in shipboard applications, where weight and space are premium considerations. Electrical distribution systems typically use batteries to accommodate sporadic loads. The energy from the batteries can quickly discharge and can charge at a much slower rate with less impact to the electrical generation system. An analogously similar thermal energy storage system is desired, and is one object of the invention.

Because the temperature of the sea typically exceeds the temperature of a typical secondary loop in a secondary loop refrigeration system, a mechanical system/cycle is required to maintain the desired temperature during sporadic use conditions. Water or water-antifreeze combination solutions are common thermal energy storage systems in commercial use, but the large volumes and weights associated with such systems make them generally not feasible for shipboard applications.

Table 1 below shows heat removal from selected fluids assuming heat is released from 125 degrees Celsius from the nominal identified temperature. It is noted that the latent heat of vaporization of water offers a good solution. The complexity and control methodology to prevent freezing of the chilled water distribution of a cryogenic system would likely prevent an installation and offer less potential than water.

TABLE 1

Heat removal from selected fluids

| Concept | Boiling Temp (° C.) Tb | Nom Temp (° C.) Tc | Sensible Heat Tc to Tb (kJ/L) | Sensible Heat Tb to 125° C. {kJ/L) | Latent heat of vaporization (kJ/L) | Total (kJ/L) | Ton-hours/L |
|---|---|---|---|---|---|---|---|
| $LN_2$ | −196 | −210 | 25.2 | 390.8 | 173.0 | 589.0 | 0.046534676 |
| Air | −194 | −213 | 33.8 | 326.8 | 190.6 | 551.2 | 0.043546143 |
| $0_2$ | −183 | −219 | 79.5 | 440.0 | 278.3 | 797.8 | 0.063031118 |
| $H_2O$ | 100 | 0.01 | 416.7 | 51.6 | 730.1 | 1198.5 | 0.094682528 |
| $H_2O$ | 100 | 50 | 208.4 | 51.6 | 730.1 | 990.1 | 0.078220245 |

Next, the two-phase behavior of typical refrigerants is examined in FIG. 1. Water is not shown on FIG. 1, but water has a significantly higher latent heat of vaporization of 970.3 BTU per pound (2256.7 kJ/kg). Most refrigerants, unlike water, cannot be released to the atmosphere and therefore must be contained within a closed-loop. The expansion volume needed for condensation is significant for water and other fluids. Water could be released since it is replenishable and can be safely discharged. This fact significantly simplifies the system and saves space and weight. The power required to replenish the water will offset the power to condense the fluid in a closed loop configuration.

The use of water as a refrigerant has several attractive benefits. Water is environmentally friendly, low cost, readily available, and non-toxic. For a one MW heat load applied over four minutes, only 28 gallons of water must boil. The instant invention, the thermal energy compensator, will provide thermal energy if the thermal load increases beyond the capabilities of the air conditioning plant. The device of the invention is at its most fundamental embodiment a flooded heat exchanger in which the return chilled water flows through the inside diameter of the tubes. Water, in a vacuum commensurate to its desired boiling temperature, is exposed to the heat transfer surface on the outer diameter of the tubes in a flooded heat exchanger arrangement. This refrigerant charge will naturally have some thermal storage of its own. During low loads of the air conditioning plant, the return temperature will be lower than normal and cool the water. As the cooling capacity increases, the temperature of the refrigerant water charge will increase. This compensation will reduce temperature spikes within the system and therefore provide less strain on the air conditioning plant and associated electrical power system. If the return temperature of the chilled water temperature system exceeds the capacity of the air conditioning plant, the refrigerant charge will begin to boil providing large amounts of cooling.

Water will boil at different temperatures as shown in Table 2. For instance, if the vacuum pressure within the refrigerant side of the leak-free thermal energy compensator was set to 29.53 inches of mercury, no boiling would occur unless the return temperature of the chilled water loop increased above 52 degrees Fahrenheit. Once the vacuum was obtained, no power would need to be applied unless the return chilled water temperature increased beyond the boiling temperature.

TABLE 2

| Boiling Temperature of Water | | |
|---|---|---|
| Boiling Temperature | Pressure | |
| (° F.) | (in. Hg) | Microns |
| 212 | 0 | 762000 |
| 192 | 1024 | 500000 |
| 152 | 22.05 | 200000 |
| 125 | 25.98 | 100000 |
| 101 | 27.95 | 50000 |
| 84 | 28.74 | 30000 |
| 72 | 29.13 | 20000 |
| 63 | 29.33 | 15000 |
| 52 | 29.53 | 10000 |
| 39 | 29.69 | 6000 |
| 29 | 29.76 | 4000 |
| 15 | 29.84 | 2000 |
| 1 | 29.88 | 1000 |
| −12 | 29.90 | 500 |
| −21 | 29.91 | 300 |
| −28 | 29.91 | 200 |
| −33 | 29.92 | 150 |
| −40 | 29.92 | 100 |

TABLE 2-continued

| Boiling Temperature of Water | | |
|---|---|---|
| Boiling Temperature | Pressure | |
| (° F.) | (in. Hg) | Microns |
| −50 | 29.92 | 50 |
| — | 29.92 | 0 |

Feedback will be necessary to maintain the vacuum levels during use. Particularly, feedback from the following sources is needed to optimize this system: Vacuum pressure in the shell side of the heat exchanger, amount of excess available air conditioning plants capacity (prevent unneeded use of the thermal energy compensator), return chilled water temperature upstream of the thermal energy compensator, and status of sporadic loads (magnitude and expected start of increased thermal load). For example, if a solid state laser or rail gun weapon system is going to fire in one minute, this system can be automatically aligned to quickly react to the large volumes of water vapor that must be removed.

Removal of the water vapor creates a challenge. Water has an extremely high specific volume at normal suction conditions for the application (boiling temperature around 52 to 55 degrees Fahrenheit). Increasing this temperature makes easier applications. Vacuum pumps equipped with magnetic bearings (http://www.turbovacuum.com/pfeiffer magnetic bearing.html) are becoming more commonplace and are useful to support this invention. The absence of lubrication fluid prevents lubricity degradation from water vapor condensing within the lubrication fluid.

Figure 2:
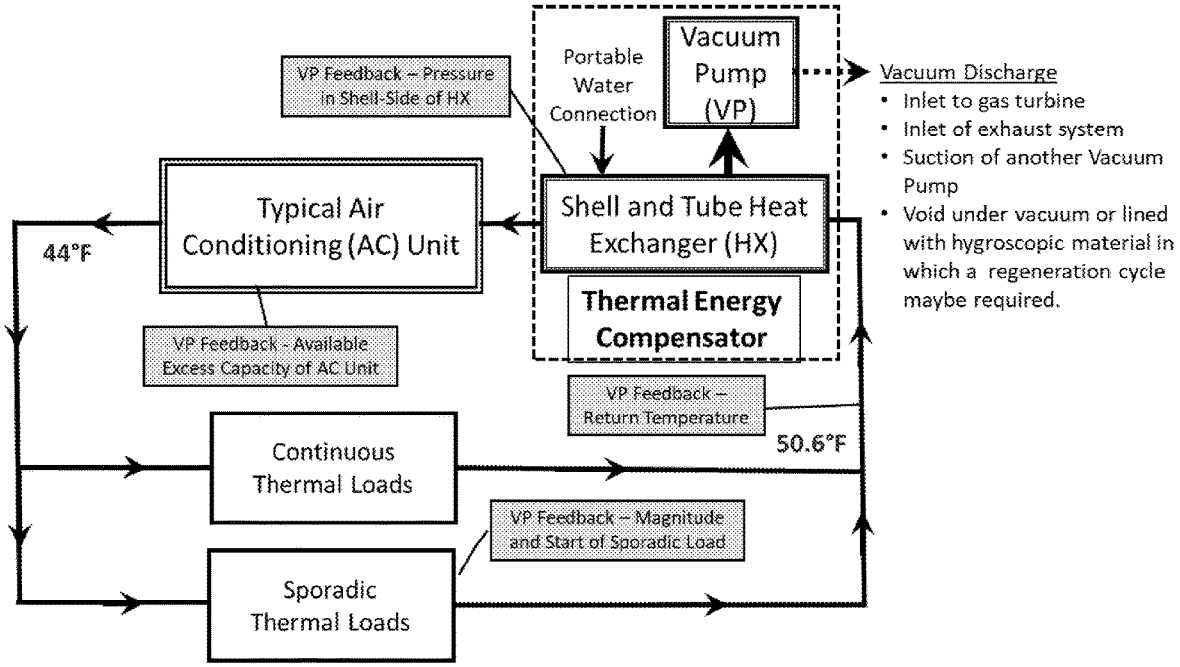
FIG. 2 depicts a schematic of one embodiment of the invention.

FIG. 2 provides a schematic of one embodiment of the invention. The exhaust water vapor may be piped to a low pressure region being exhausted from a ship. Water vapor entering the gas turbine engines would increase the electric power generation of the engine. A void (empty or useless volume that is available) could be utilized to provide a region of storage to improve the capacity of the thermal energy compensator. Utilization of an existing void structure will have no weight impact to the ship, which is beneficial.

The thermal energy compensator of the invention will perform load leveling to reduce load transient fluctuations at the air conditioning unit. This will promote less stress on key air conditioning components and associated electrical systems. The thermal energy compensator of the invention will also promote increased energy efficiency. Typically, additional air conditioning units are employed to accommodate for sporadic changes in load. If an air conditioning plant shuts down, the chilled water system can be redistributed to easily maintain this system. With a reliable thermal energy compensator, fewer air conditioning plants, chilled water pumps, and seawater pumps will likely be operating during most conditions.

Sporadic thermal loads are thus handled by the invention in a fraction of the space, weight, and volume used for additional air conditioning units. Discharging the water vapor into the entering gas turbine generator will increase electrical power generation when power will likely be needed. In one embodiment, the technique could be combined with an absorption or adsorption cycle (optionally with a solenoid valve allowing exposure) to assist in the low vacuum levels required in the shell side of the heat exchanger.

The present invention is not to be limited in scope by the specific embodiments described above, which are intended as illustrations of aspects of the invention. Functionally equivalent methods and components are within the scope of the invention. Various modifications of the invention, in addition to those shown and described herein, will be readily apparent to those skilled in the art from the foregoing description. Such modifications are intended to fall within the scope of the appended claims. All cited documents are incorporated herein by reference.

What is claimed is:

1. A thermal energy compensator for use in conjunction with an air conditioning unit, comprising:

a shell and tube structured heat exchanger flooded with water in an initial condition; and a vacuum pump operably connected to an inlet of a turbine engine and to an exhaust fan;

wherein the thermal energy compensator is connected in line with the air conditioning unit; and the thermal energy compensator operates subject to a plurality of feedback loop systems;

whereby incoming water is provided at a supply temperature, and outgoing water is provided at a return temperature; and when a demand for cooling exceeds a native cooling capacity of the air conditioning unit, the thermal energy compensator provides additional cooling capacity.

2. The thermal energy compensator of claim 1, wherein the feedback loop systems comprise at least one member selected from the group consisting of:

pressure on a shell side of the shell and tube structured heat exchanger;

current cooling load and available excess capacity of the air conditioning unit;

magnitude and starting point of a sporadic load; and the return temperature.

3. The thermal energy compensator of claim 2, wherein the return temperature is maintained at a constant desired level.

4. The thermal energy compensator of claim 1, wherein the supply temperature is lower than the return temperature.

5. The thermal energy compensator of claim 4, wherein the supply temperature is 44° F. and the supply temperature is 50.6° F.

* * * * *